US005881592A

United States Patent [19]

Blackwell et al.

[11] Patent Number: 5,881,592

[45] Date of Patent: Mar. 16, 1999

[54] FLOATING PLUG FOR DRAWING OF TUBES

[75] Inventors: Ellis Blackwell, Concord, Ohio; Darrell K. Maisel, Hannibal, Mo.

[73] Assignee: Cerro Copper Products Co., Del.

[21] Appl. No.: 64,293

[22] Filed: Apr. 22, 1998

[51] Int. Cl.[6] ..... B21C 1/24

[52] U.S. Cl. ..... 72/283; 72/370.17

[58] Field of Search ..... 72/283, 276, 208, 72/209, 68, 370.16–370.18

[56] References Cited

U.S. PATENT DOCUMENTS

| | | | |
|---|---|---|---|
| 1,318,962 | 10/1919 | Brinkman . | |
| 4,373,366 | 2/1983 | Tatsumi | 72/283 |
| 4,476,704 | 10/1984 | Hage | 72/276 |
| 4,942,751 | 7/1990 | Fuchs, Jr. | 72/283 |
| 4,947,669 | 8/1990 | Fuchs, Jr. | 72/283 |
| 5,016,460 | 5/1991 | England | 72/208 |
| 5,327,756 | 7/1994 | Fox | 72/68 |
| 5,526,663 | 6/1996 | Sauvonnet | 72/283 |

FOREIGN PATENT DOCUMENTS

| | | | |
|---|---|---|---|
| 231523 | 11/1985 | Japan | 72/283 |
| 1146112 | 3/1985 | U.S.S.R. | 72/209 |
| 1470386 | 4/1989 | U.S.S.R. | 72/283 |

*Primary Examiner*—Daniel C. Crane
*Attorney, Agent, or Firm*—Richard A. Speer; Mayer Brown & Platt

[57] ABSTRACT

A draw tool and process for producing internally finned copper tubing in which the draw tool has longitudinally extending exterior teeth and grooves having working surfaces that are shaped at interacting angles providing metal flow at tensile forces below the ultimate tensile strength of the tubing.

10 Claims, 3 Drawing Sheets

$\alpha_1 = 14° - 18°$
$\alpha_2 = 12.5° - 16.5°$
$\beta_1 = 1.5° - 2.75°$
$\beta_2 = 2.25° - 3.5°$

FLOATING PLUG FOR DRAWING OF TUBES

BACKGROUND OF THE INVENTION

FIELD OF THE INVENTION

The present invention relates to improved apparatus and method for forming grooves in the inner wall surface of metal pipes, tubing and the like. The apparatus for effecting the grooving is embodied in a floating plug of the type used in drawing tubes from a larger to a smaller diameter, with or without a corresponding reduction in wall thickness. The plug has external teeth means which extend axially along the plug and which are specially configured and dimensioned to define approach and bearing portions that, in cooperation with a surrounding die, effect plastic deformation of the inner tube wall into the desired grooved geometry. Depending upon the depth of groove desired (or corresponding rib height) one or more draws may be effected to achieve final dimensions. Generally, to obtain full groove depth, multiple draw passes are made, to increase the depth of the groove incrementally; this to preclude the drawing tension from exceeding the ultimate tensile strength of the tube and causing tube rupture.

BACKGROUND

Most prior art apparatus and methods involved the use of a grooving plug that was held in a fixed location within a tube, the plug having a grooved or toothed outer surface that would produce a reverse image surface in the tube inner wall. The grooving plug could, depending on the length of tube being grooved be held in the required fixed position by an elongate element like a mandrel or it could be attached to a floating draw plug. In either case deformation of the tube about the grooving plug was effected by equipment such as rollers or balls that exerted radial pressure on the outer wall of the tube in the region directly over the plug. An example of this type of apparatus for producing inner grooving in a tube can be seen in U.S. Pat. No. 4,373,366.

U.S. Pat. No. 5,327,756 describes method and apparatus whereby it is proposed to produce interior spiral grooves in tubes by means of a floating plug draw-die combination without the use of apparatus which includes separate means applying radially directed groove forming forces in the tube. While this patent presents an appealing concept, it was never possible to translate the concept into apparatus and method capable of commercial success.

While prior art methods had varying degrees of success and acceptability in the industry there remained a balance that had to be struck between rate of production, scrap rate, quality of product and manufacturing costs, for example.

Thus, it is a principal object of the invention to provide improved floating plug apparatus and method for the internal grooving of tubes and the like during a drawing operation.

Another object of this invention is to provide apparatus and method for the internal grooving of tubes and the like which is effected in multiple draws during reduction in tube diameter.

An additional object of this invention is to provide an externally toothed grooving plug in which the configuration and dimensioning of the teeth are such as to permit the use of low tensile forces in effecting tube drawing operations.

Other objects and advantages of this invention will be in part obvious and in part explained by reference to the accompanying specification and drawings, in which.

Figure 6A:
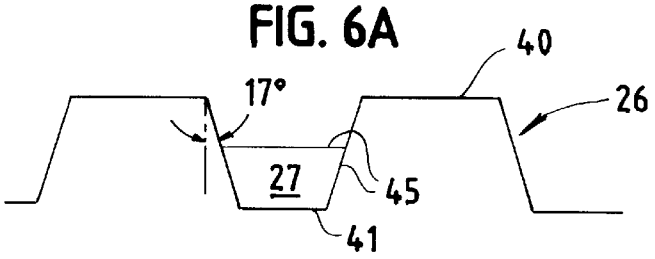
Figure 6B:
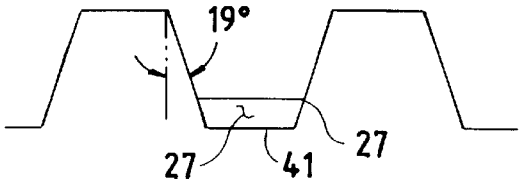
Figure 6C:
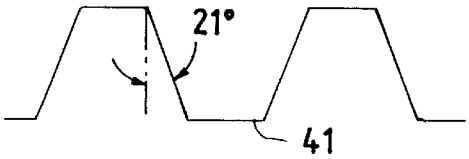
Figure 7A:
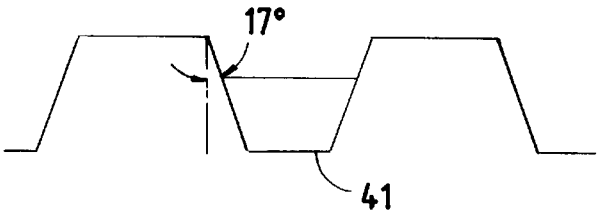
Figure 7B:
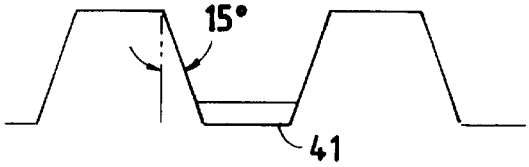
Figure 7C:
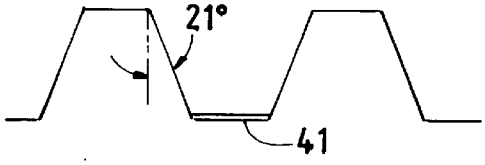
Figure 8:
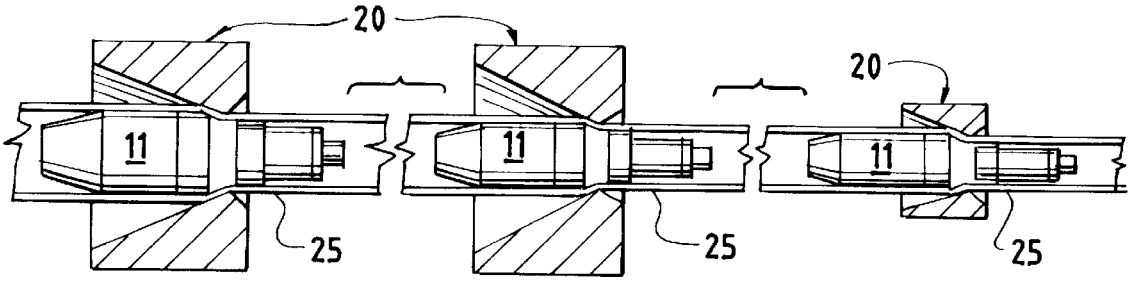

FIGS. 6(*a*)–6(*c*) are diagrammatic illustrations of tooth profiles in the approach portion of draw tools for making multiple reductions;

FIGS. 7(*a*)–7(*c*) are diagrammatic illustrations of tooth profiles in the bearing proportions of draw tools for making multiple reductions;

FIG. 8 is a side elevation, diagrammatically illustrating how multiple reductions in tube size can be effected.

DESCRIPTION OF THE INVENTION

Figure 1:
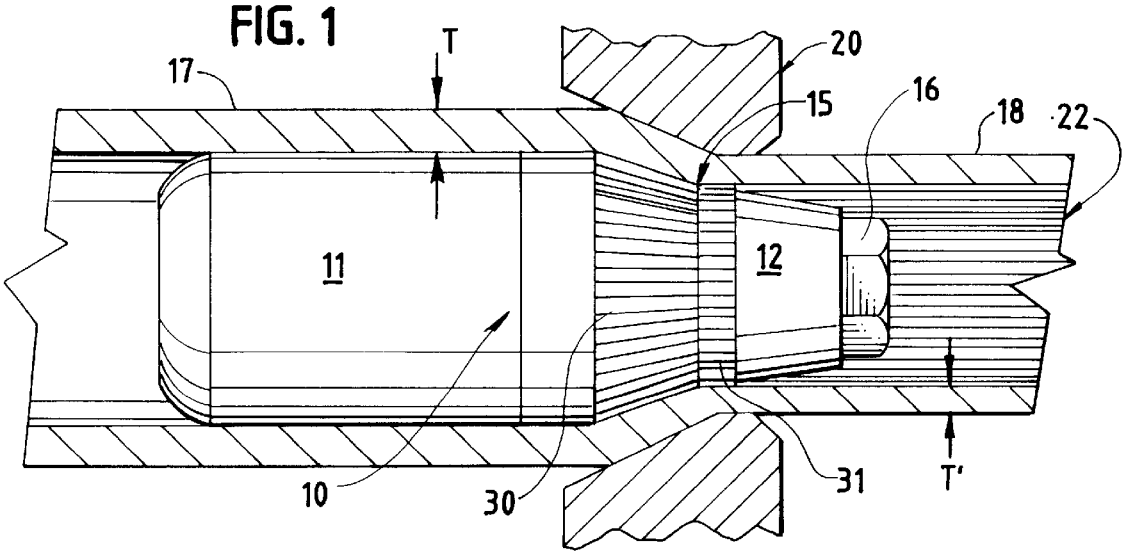
FIG. 1 is a partially sectioned side elevation of a floating plug incorporating the draw tool of this invention, showing the plug as it would be located within a tube and draw die.

For a better understanding of the invention, reference is made to the drawings and specifically to FIG. 1 in which numeral 10 indicates a floating plug of the type that is frequently used for drawing tube stock from a larger to a smaller diameter and simultaneously reducing the wall thickness of the starting tube. Floating Plug 10 is comprised of a plurality of individual parts that are secured together by suitable means to form a unitary structure. Specifically the plug includes a ball portion 11, a nose portion 12 and a draw tool 15 which is positioned intermediate ball portion 11 and nose portion 12. The draw tool 15 is that part of the floating plug with which the present invention is concerned and it is held in position between body 11 and nose 12 by suitable fastening means such as the bolt 16 that extends towards the left as viewed in FIG. 1 and into engagement with the ball portion 11. Floating Plug 10 is positioned in the interior of a tube 17 which is to be drawn into a tube 18 of smaller diameter and increased length. Additionally, it can be seen that the wall thickness T of the tube prior to drawing may or may not be greater than the thickness $T^1$ of the tube wall following drawing. As the tube is drawn over the floating plug it enters into a circular orifice defined by draw die 20, it is drawn into the orifice and over the draw tool 15 where it is forced into contact with shaped outer surface of draw tool 15. This operation may or may not result in the wall thickness of the tube being reduced and simultaneously results in metal being forced into grooves that are present around the outer surface of the generally circularly cross-sectionally shaped draw tool. It is the action of forcing the inner wall of tube 17 into the grooves on the outer surface of draw tool 15 that results in the creation of the longitudinally extending grooves and ridges indicated generally at 22.

Figure 2:
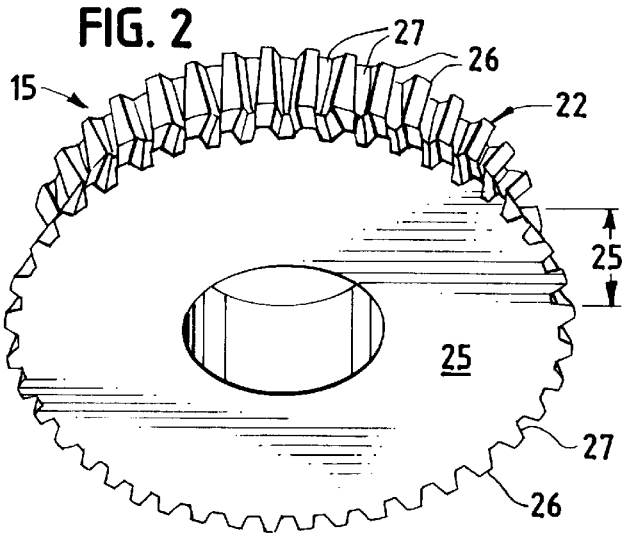
FIG. 2 is a perspective view of the draw tool of this invention looking from the entrance toward the exit end of the tool.
Figure 3:
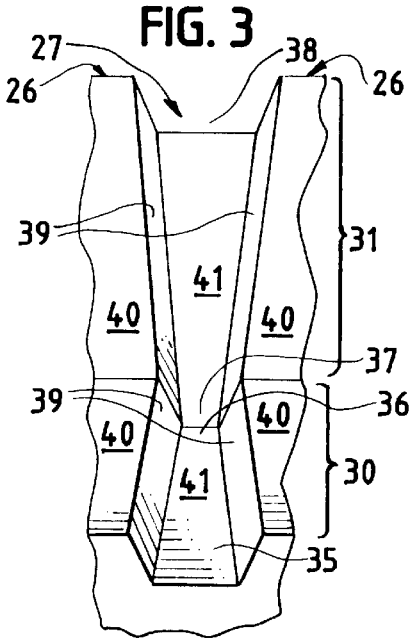
FIG. 3 is an enlarged perspective view of one of the draw tool linear grooves formed by draw tool arcuately spaced teeth.

Draw tool 15 is made up of an elongate body portion 25 that extends along the axis of the floating plug 10. Body 25 is of substantially circular cross-sectional shape and has teeth means formed on its external surface. The teeth means is made up of arcuately spaced teeth 26 having a trapezium or trapezoidal profile, which teeth extend linearly along body portion 25. Separating each pair of adjoining teeth 26 are grooves 27, that extend linearly along the body between teeth 26 and have a profile which is essentially identical to the profile of teeth 26 but which is inverted with respect to the teeth. The teeth means then are comprised of teeth 26 and grooves 27 which extend linearally throughout the entire length of body 25. Draw body 25 as seen in FIGS. 1 and 2, is comprised of an approach portion 30 and a bearing portion 31 in which the teeth 26 decline toward the axis of the plug 10 at a first angle in the approach portion 30 and thereafter decline either parallel toward the axis of plug 10 in the bearing portion or at an angle which is less than the angle of declination in portion 30. The angles at which the crests of the teeth and the angles at which the intervening grooves decline toward the axis of floating plug 10 and draw body 25 are significant and are discussed in detail below.

Grooves 27 in the approach portion 30 of the teeth means have inlet ends 35 and outlet ends 36, while the continuation of grooves 27 in the bearing portions have inlets 37 and outlets 38. The outlets 36 and inlets 37 are located is immediately adjacent each other, but the cross-sectional area of inlet 37 is slightly greater than that of the outlet 36. In the approach portion, the teeth 26 are shaped in such a way that the grooves 27 are of constant decreasing cross-sectional area in the direction from the inlet 35 toward the outlet 36. The constant size in the cross sectional area from one and of the groove in the approach portion 30 is accomplished by having the side walls 39 parallel to each other from the outer surface at the crest 40 of the teeth toward the place where they join with the bottom surface 41 of the groove and by simultaneously having the walls remain parallel to each other in the direction from end 35 to end 36. The decreasing size in the cross sectional area from one end of the groove in the approach portion 30 is accomplished by having the side walls 39 converged toward each other from the outer surface at the crest 40 of the teeth toward the place where they join with the bottom surface 41 of the groove and by simultaneously having the walls converge towards each other in the direction from end 35 to end 36.

Figure 4:
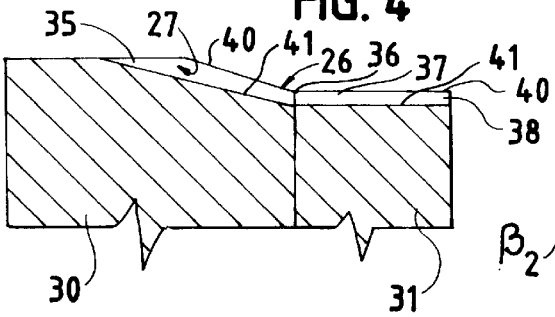
FIG. 4 is a section through a draw tool groove showing a tooth and groove profile.
Figure 5:
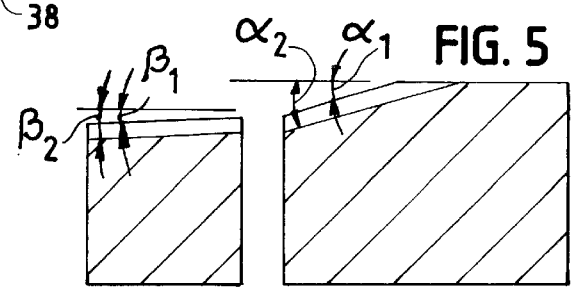
FIG. 5 is a section through a draw tool showing the angular relationship between critical deformation surfaces.

Referring to FIG. 4, it can be seen that the crest 40 of tooth 26 in the approach portion 30 declines toward the axis of plug 10 at an angle which may be equal to or greater than the similar angle of declination of bottom 41 of groove 27. In contradistinction, in the bearing portion the crests 40 of the teeth may parallel the axis of plug 10 or may decline at an angle 41 which is less than the angle of declination of the bottom of the groove 27. In addition, in the bearing portion 31 of the teeth means it can be seen that the side walls 39 may be parallel or diverge from a position at the entry 37 extending toward the outlet end of 38 groove 27. Also, the angle of declination of each tooth crest 40 in the bearing portion 31 parallels or declines toward the axis of plug 10 at an angle which is equal to or is less than the angle of declination of the bottom 41 of groove 27.

As described above, the teeth in the approach portion 30 have crests 40 that decline at a preselected first angle toward the axis of the draw tool body in the direction from the inlet end 35 toward the outlet end 36. In addition, the height of the teeth in portion 30 either remains constant or decreases relative to the groove depth in the same direction. The teeth in the bearing portion of the draw tool either parallel the axis of plug 10 or decline at a preselected second angle, which is different from the first angle in the approach portion, toward the axis of the draw body. The teeth, in the bearing portion of the draw tool parallel or decline at a preselected second angle toward the axis of the draw body, which angle is equal to or is less than the first angle in the approach portion and the height of the teeth either remain constant or increase relative to the groove depth in the same direction.

So that effective deformation of the inner wall of tube 17 can be accomplished to produce the longitudinally extending internal grooving, it has been found that when drawing copper, for example, the tooth crests 40 in the approach section 30 should decline at an angle $\alpha$, ranging from about 10 degrees to 18 degrees. In the approach section 30 the grooves base surfaces 41, on the other hand preferably decline at an angle $\alpha_2$ ranging from about 8.5 degrees to 18.0 degrees. Thus, in the approach section 30 the angle of declination of the tooth crest may equal or exceed that of the grooves by an angle up to about three degrees. The tooth crests 40 in the bearing section 31 are either parallel to the plug axis or decline at an angle $\beta_1$ of up to about 3.00 degrees while the groove surfaces 41 in the same region are constructed to equal angle $\beta_1$ or to decline at an angle $\beta_2$ of up to about 3.75 degrees. Thus the angle of declination of the tooth crests in the bearing area is the same as or less than that of the grooves. The angular relationships existing between the tooth crest and groove base surfaces in the approach and bearing portions of the draw tool are significant to the success of the present invention in having the ability to obtain internally ridged copper tubing. The significance of the angular relationships rests in the fact that the metal must be caused to flow downwardly and forwardly into and through the relatively narrow throat created at the exit end 36 of the groove 27 in the approach portion 30.

Depending upon the nature of the metal being drawn, it may be necessary to utilize multiple draw reductions. That is, rather than effecting the entire reduction in a single pass through a draw die, it may be necessary to reduce the diameter and the wall thickness of the initial tube in a series of separate drawing stages. This feature is illustrated in FIG. 8 of the drawings where it can be seen that the initial tube 17 is drawn through the die block to make a first reduction and is thereafter drawn through successive second and third draw stages to reduce the tube to the final desired diameter and wall thickness. The illustration of three stages is intended to be only by way of example since the number of reductions effected in any given instance will depend solely upon the material being worked and the end result desired. That is, given the proper material, reduction in size might be accomplished in a single stage or may require two or three or more reductions which are each less drastic than would be a single stage reduction. It should be noted that multiple reductions are carried out in distinct stages, since it is not possible to draw tubing through multiple, serially disposed dies.

FIGS. 6(*a*) through 6(*c*) and 7(*a*) through 7(*c*) illustrate the tooth and valley profiles that exist at the interface between the approach portion 30 and bearing portion 31 of the draw tool 15 at the exit end 36 of approach portion 30 and at the entrance end 37 of bearing portion 31. FIG. 6(*a*), for example, shows the profile of the teeth 26 as they would appear at the exit end 36 of approach portion 30 in the first stage of the draw. In FIG. 6(*a*) it can be seen that the side walls 39 which define the lateral limits of groove 27 are angled inwardly toward bottom 41 at an angle ranging from about 17 to 21 degrees. At the second stage it can be seen that the distance between the centers of adjoining tooth crests 40 is slightly less than the distance between the center of the tooth crests in FIG. 6(*a*). The same relationship is true when the tube is sent into the third stage where the distance between adjacent teeth is smaller still. In the second and third stages, the angle of the side walls defining the grooves 27 equals the previous stage or increases up to three degrees for each stage and the size of the trapezium or trapezoidal teeth become commensurately smaller. It may be noted that the angle of inclination of the groove forming side walls shown in FIGS. 7(*a*) through 7(*c*) as they exist in the bearing portion are identical to the angles present in the approach portion. Thus, if a three stage reduction were to be effected, the inner wall of tube 17 would first be formed to have ridges or teeth that extended downwardly into groove 27 to about the point indicated by the line at numeral 45. In the second stage the line 45 would be located further down into the groove 27 and finally by the third stage the complete inner wall tooth or ridge would be formed and the height of the ridge would correspond to the complete depth of groove 27.

Whereas, in the approach portion of the teeth means the purpose is to increasingly constrain the metal and cause it to flow downwardly and inwardly into the groove until it reaches the exit port at location 36, it is essential to the effective operation of this invention that room for the metal to relax and expand slightly must be provided after the metal has passed the cross-section of minimum area. This is the reason for having the outwardly oriented side walls 39 in bearing portion 31 and for allowing also for a slight radial expansion of the metal by having the base 41 of the groove diverge slightly from the tooth crest surface in portion 31.

While the invention has been described in connection with a preferred embodiment, it is not intended to limit the invention to the particular forms shown and described. It is intended to cover such alternatives, modifications and equivalents as may be included within the spirit of the invention as defined in the appended claims.

It is hereby claimed:

1. A draw tool for grooving the inner wall of tubing during draw reduction of tubing diameter through an annular die opening, the draw tool comprising:

(a) an elongate draw tool body portion of substantially circular cross-sectional shape;

(b) teeth means having external, arcuately spaced teeth extending along the body portion and having grooves extending along the body between the teeth;

(c) an approach portion in the teeth means wherein the teeth are shaped such that the grooves are of decreasing cross-sectional area in the direction from an inlet to an outlet end thereof;

(d) a bearing portion in the teeth means wherein the teeth are shaped such that the grooves are of increasing cross-sectional area in the direction from an inlet to an outlet end thereof.

2. A draw tool as defined in claim 1 wherein:

the teeth in the approach portion have crests that decline at a preselected first angle toward the axis of the draw tool body in the direction from an inlet end toward an outlet end and the height of the teeth decreases relative to groove depth in the same direction; and the teeth in the bearing portion decline at a preselected second angle toward the axis of the draw body in the direction from an inlet end toward an outlet end which angle is less than the first angle in the approach portion and the height of the teeth increases relative to the groove depth in the same direction.

3. A draw tool as defined in claim 1 wherein surfaces defined in claim 1 wherein surfaces defining the side walls of the teeth and the bottoms of the grooves in the approach portion converge in the direction toward the outlet end of the approach section to form a groove outlet opening that defines the inlet opening into the draw tool bearing portion.

4. A draw tool as defined in claim 3 wherein surfaces defining the side walls of the teeth and the bottoms of the grooves in the bearing portion diverge in the direction away from the inlet opening so that the cross-sectional area of the grooves is progressively larger toward the outlet end.

5. A draw tool for grooving the inner wall of tubing during draw reduction of tubing diameter through an annular die opening, the draw tool comprising:

(a) an elongated draw tool body portion of substantially circular cross-section shape;

(b) teeth means having external, arcuately spaced teeth extending along the body portion and having grooves extending along the body between the teeth;

(c) an approach portion in the teeth means wherein the teeth crests decline at a preselected first angle toward the axis of the draw tool body and the height of the teeth decreases relative to groove depth; and (d) a bearing portion in the teeth means wherein the teeth crests decline at a preselected second angle toward the axis of the draw body which angle is less than the first angle in the approach portion and the height of the teeth increases relative to groove depth.

6. A draw tool as defined in claim 1 wherein the arcuately spaced teeth are of substantially trapezium profile.

7. A draw tool as defined in claim 2 wherein the grooves have a substantially trapezium or trapezoidal profile that is inverted relative to the teeth profile.

8. A draw tool as defined in claim 1 or 2 wherein the grooves in the approach section decline toward the axis of the draw tool body at an angle equal to or smaller than the angle of declination of the teeth crests and in the bearing section decline at an angle equal to or greater than the teeth crest second angle.

9. A draw tool as defined in claim 1 wherein in the approach section the tooth crests decline at an angle ranging from about 10° to 18°, the grooves decline at an angle ranging from about 8.5° to 18.0° and the angle of declension of the teeth crests exceeds that of the grooves by any angle ranging from about 0° to 3°; and in the bearing section the teeth crests decline at an angle ranging from about 0° to 2.75°, the grooves decline at an angle ranging from about 0 to 3.75, and the angle of declension of the teeth crests is less than that of the grooves by an angle ranging from about 0° to 0.75°.

10. In a process for producing longitudinally extending grooves on the inner wall of tubing, the steps comprising:

providing a draw tool having teeth means including external, arcuately spaced teeth and teeth separating grooves extending linearly along the surface thereof providing an approach portion in the teeth means wherein the cross-sectional area of the grooves decreases in the direction from an entrance end toward an exit end;

providing a bearing portion on the teeth means wherein the cross-sectional area of the grooves increases in the direction away from an entrance end which is adjacent the approach portion exit end and toward an exit end; and drawing the tube through an annular die opening over the draw tool to produce internal fins and grooves on the tube inner wall.

* * * * *